United States Patent [19]

de Saint Palais et al.

[11] 4,058,137

[45] Nov. 15, 1977

[54] RISER PIPE FOR PIVOTALLY ATTACHED STRUCTURE USED TO EXTRACT PETROLEUM FROM BENEATH A BODY OF WATER

[75] Inventors: Jacques de Saint Palais; Paul Laffont, both of Pau; Jean Mourlevat, Cazeres, all of France

[73] Assignee: Societe Nationale Elf Aquitaine (Production), Courbevoie, France

[21] Appl. No.: 675,556

[22] Filed: Apr. 9, 1976

[30] Foreign Application Priority Data

Apr. 14, 1975 France ..... 75.11505

[51] Int. Cl.[2] ..... E02D 21/00

[52] U.S. Cl. ..... 137/236 S; 61/95

[58] Field of Search ..... 61/88, 95; 137/236

[56] References Cited

U.S. PATENT DOCUMENTS

| | | | |
|---|---|---|---|
| 3,522,709 | 8/1970 | Vilain | 61/95 |
| 3,677,016 | 7/1972 | Garrigus | 61/95 |

*Primary Examiner*—Robert G. Nilson

*Attorney, Agent, or Firm*—Brisebois & Kruger

[57] ABSTRACT

A riser pipe consists of a plurality of sections of production pipe which are centered and free to slide axially in a guide shaft. The guide shaft is fixed to a pivoted structure and the riser pipe comprises a lower section which is connected at one end to piping at the bottom of the water by means of a remotely controlled releasable connector and at the other end to the penultimate section of the pipe by a connector which is longitudinally slidable to the said guide shaft. The bending stresses on the pipe may be distributed over the length of a lowermost section which may be removed and replaced from the surface.

11 Claims, 5 Drawing Figures

22
23
21
26'
9'
20
9
33
17
18
19
24
2
3
12
26'
24
10
7
33
1
11
33'
16
15
26
32
25
5
13
14a
14
8'a
14''
34
8'
14'
4
8
6

43
41
42
46
47
40
16
37
44
36
45
15
IV
IV
16
35
39
39
38

15
38
45

RISER PIPE FOR PIVOTALLY ATTACHED STRUCTURE USED TO EXTRACT PETROLEUM FROM BENEATH A BODY OF WATER

SUMMARY OF THE INVENTION

This invention relates to a riser pipe for pivotally attached structures for extracting petroleum in deep water.

The use of pivotally attached structures as supports for platforms for extracting petroleum in deep water presents the problem of adapting the riser pipe to the particular conditions of use in the sea and especially to the oscillations of those pivotally mounted structures.

The types of pivotally mounted structure heretofore known have a pivot consisting of a universal joint connecting the support of the platform to a fixed base anchored in the sea floor.

It is known to install one or more riser pipes connecting the base pipes to the installations carried by the platform, said pipes being distributed about the axis of the platform in an eccentric position with respect to said axis and especially in an eccentric position with respect to the universal joint.

Various types of riser pipes are known, centered by means of elastic centering devices in a guide shaft fixed to the pivotally mounted structure and extending between the platform and an end 10 to 20 meters above the sea floor. Such a riser pipe is connected to a base pipe by connecting means equivalent to a fitting and is located in the guide shaft by centering devices. The lower part of the riser pipe acts as a beam seated at one end and free at the other end so that the bending forces are unequally distributed along the length of the lower part of the pipe, not only between the connection to the base pipe and the first centering means, but also beyond the first centering means. At any given bending position of the pipe, the bending moment at each point is a function of the radius of curvature of the pipe at that point so that the curve of deformation of the pipe, for a given inclination of the pivoted structure, depends on the characteristics of the centering devices, especially of the centering device which is lowermost in the guide shaft, and the state of the centering devices. In such riser pipes the distribution of the zones of maximum bending force, within which ruptures may eventually occur, along an important part of the pipe, is difficult to anticipate.

Such riser pipes are substantially eccentric with respect to the pivoted structure so that the relative movements of the pipe with respect to the guide shaft are quite substantial. It is therefore necessary to allow for these relative movements at the level of the platform, which necessitate substantial mechanical installations to absorb them.

Each riser pipe could be connected to the corresponding base pipe by means of universal joints. Such an arrangement would make it possible to refer the changes in orientation of each pipe resulting from the oscillations of the pivotally mounted structure to the ends of the axes of the universal joint at which the torsion joints are located. This arrangement is applicable only to two riser pipes and it may be noted that the problems posed by the maintenance of the torsion joints render their use difficult at very great depths.

The present invention makes it possible to at least partially overcome these difficulties, on the one hand by localizing the torsion forces equally distributed along a lower section of the production pipe which acts as a member seated at its two ends and, on the other hand, passing said lower member through a passage in the universal joint.

A riser pipe for a pivotally mounted structure for extracting petroleum in deep water rests on a base to which it is attached by a universal joint and consists of pipe sections connected together, including an upper pipe section having its outer surface polished and sliding in a fluid-tight annular seal which forms part of a plug member fixed to the upper opening of a guide shaft, said guide shaft being fixed to the pivotally mounted structure, and said riser pipe defining with the guide shaft an annular space filled with oil. The riser pipe is centered in the guide shaft by means of an elastic centering device pierced by channels connecting the annular spaces above and below the centering device.

A riser pipe according to the invention is characterized by the fact that it comprises a lower pipe section connected on to a base pipe by means of a separable joint remotely controlled from the surface, and constituting a fitting. This joint comprises a member fixed to the lower section of the riser pipe and a member fixed to the base pipe. The lower pipe section is connected to the next section of the riser pipe by means of a connector in the form of a mobile piston which is longitudinally slidable in a cylindrical seat consisting of the lower section of the guide shaft, said cylindrical seat having an inner diameter slightly less than the diameter of the remainder of the guide shaft, said connector constituting a piston including means providing communication between the annular spaces above and below said connector, the part of the separable joint fixed to the member of the lower pipe section having an outer diameter less than the inner diameter of the cylindrical seat of the connector constituting a piston.

In a preferred embodiment of the invention the lower section of the riser pipe has inner and outer polished surfaces provided with an anti-corrosion coating.

In order to be able to replace the cylindrical seat after it has become worn, said cylindrical seat consists of a sleeve having an outer diameter slightly less than the inner diameter of the guide shaft, said sleeve being anchored to a seat fixed to the inside of the guide shaft near the lower end of the guide shaft.

In order to insure the maximum safety of the installation, the lower pipe section is provided with a safety device consisting of a rupturable duct fixed to said lower section and connected to the hydraulic control circuit for the safety valves of the collector pipes, said safety valves being of the motorized type which close in the absence of pressure in the control cicuit.

The best conditions of operation of the pipe are obtained when the lower pipe section is positioned to one side of the center of the universal joint.

In the various embodiments, on the one hand, the annular plug in the upper opening of the guide shaft is easily removable and when it is removed, clears the entire section of the guide shaft and, on the other hand, the guide shaft is surmounted by means for suspending the pipe at a constant tension.

In the various embodiments of riser pipes having a diameter less than 125 mm, said riser pipes consist of sections of production pipe.

In those riser pipes having a diameter greater than 125 mm, the lower section consists of an elastomeric tube, preferably of a reinforced elastomeric tube.

In all the embodiments, when space permits, the lower section passes through an axial passage in the universal joint.

The invention will be better understood from the following description, given purely by way of illustration and example, of a preferred embodiment of the invention, with reference to the accompanying drawings; in which FIG. 1 is a schematic view of a riser pipe for a pivotally mounted structure for extracting petroleum from deep water;

Figure 1:
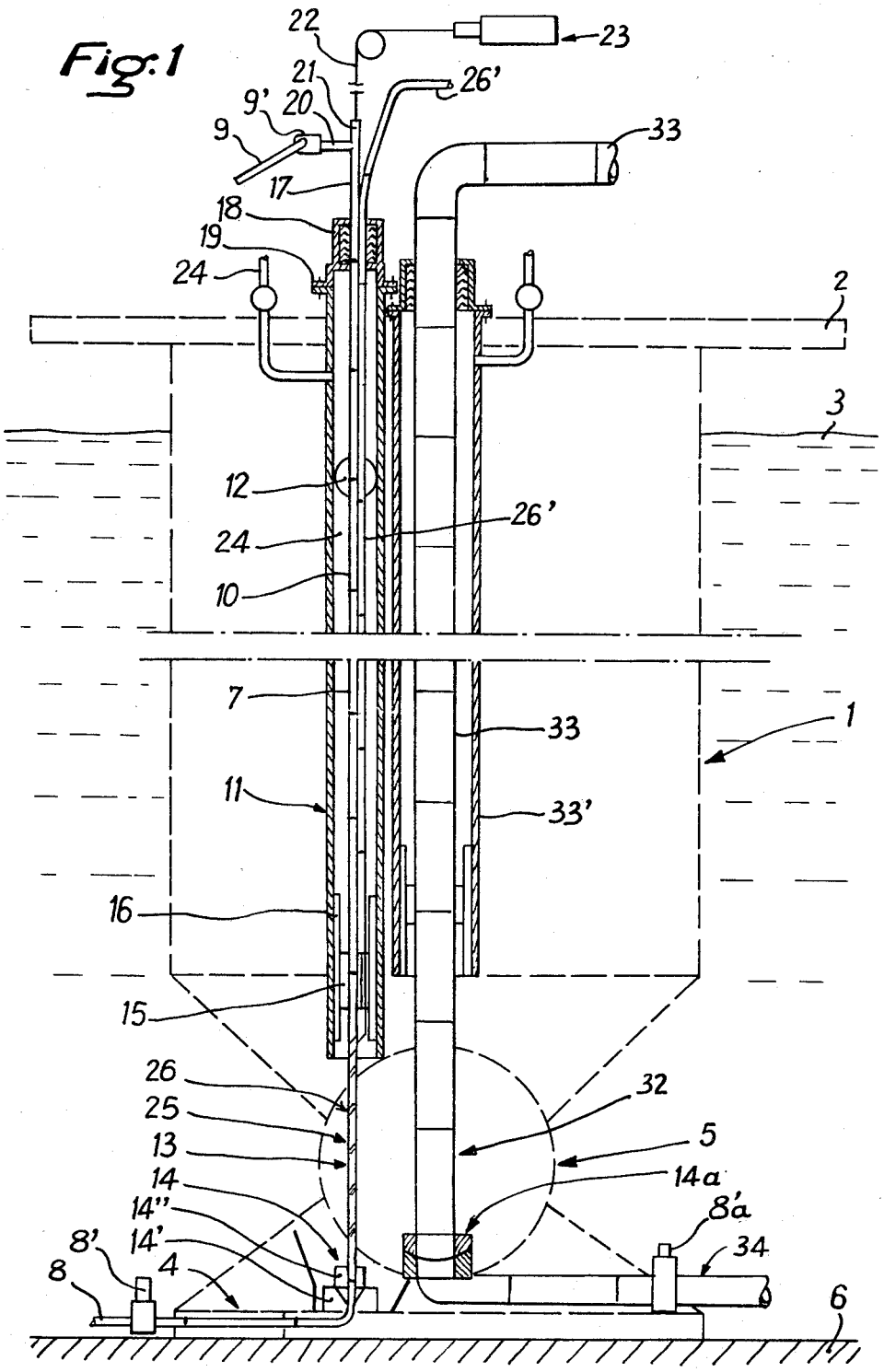

Referring now to FIG. 1, this shows schematically in broken lines a structure 1 supporting a platform 2 situated above the level of the sea 3 and resting on a base 4 to which it is connected by a universal joint 5, the base 4 being connected to the sea floor 6.

The pivotally mounted structure is used as a support for an installation for producing petroleum in deep water. This installation comprises one or more riser pipes such as the pipe 7 shown in FIG. 1. Such a riser pipe 7 connecting a base pipe 8 to an outlet pipe 9 in the open air consists of sections of production pipe 10 connected to each other by connecting means.

The pipe 7 is centered in a guide shaft 11 by means of elastic centered devices 12, which are equally spaced. The guide shaft 11 is attached to the pivotally mounted structure and opens above the platform 2.

The pipe 7 comprises a lower section 13 made of production pipe between 8 and 12 meters long and externally polished, and provided with an anti-corrosion coating inside and out. The lower section 13 is connected at its bottom to the base pipe 8 by means of a releasable connector 14, consisting of a fitting which is remotely controlled from the surface. A safety valve 8' is mounted on the base pipe. This valve is closed by a drop in pressure in the hydraulic control circuit, which may be produced either by manual control means or by the operation of a safety device.

The releasable connector 14 comprises a part 14' fixed to the base pipe by a very strong separable joint and adapted to remain at the bottom for a long time, possibly permanently, and a part 14" fixed to the lower end of the lower section 13 of the riser pipe. Only this part 14" is provided with sealing means. The two parts 14' and 14" are provided with the mating parts of a separable fastener.

The releasable connector 14 may be of the mechanical type such as the fluid type releasable connector for production pipes (anchor tubing seal assembly) Model E, page 399, FIGURE V-29 of the composite catalog for 1974–75 edited by World Oil of Texas.

The releasable connector 14 may also be of a hydraulic type such as one of those used at submarine well heads.

Lower section 13 is connected to the next section of the pipe by means of a connector 15 constituting a piston which is longitudinally slidable in the guide shaft 11. Connector 15 has a length of about 40 cm and slides with a play of the order of 1 mm in a fixed sleeve 16 about 200 cm long in the lower part of the guide shaft 11.

The outer diameters of the different sections of the pipe 7, the member 14", the separable joint 14, and the connector 15 acting as a piston are less than the inner diameter of the sleeve 16, which is itself less than the inner diameter of the guide shaft 11. This permits the pipe 7 to pass through the sleeve 16 and the guide shaft 11.

The outer diameter of the sleeve 16 is less than the inner diameter of the guide shaft 11 which makes it possible for the sleeve 16 to pass through the guide shaft 11.

The pipe 7 comprises an upper section 17, the outer surface of which is polished. The upper section 17 slides in an annular seal 18, shown here as a stuffing box, constituting the central part of a casing plug 19 mounted on the upper opening of the guide shaft 11.

This plug 19 is either screwed or bolted to a collar. Regardless of the method of attachment, removal of the plug member 19 must clear the entire section of the guide shaft.

The upper section 17 is connected to a terminal tube 20 which is T-shaped, with one lateral branch leading to an outlet pipe 9 for the extracted fluids, an absorption device 9' for displacements being located in the pipe 9, while the pipe 21 connected to the pipe 7 is closed and carries the mounting 22 of the device 23 for suspending the riser pipe at a constant tension. The column 7 and the guide shaft 11 define an annular space 24 which is filled with oil. The guide shaft 11 carries at its upper end near the platform 2 a valved inlet-outlet pipe 24 for filling and emptying the guide shaft.

The elastic centering devices 12, like the connector 15, each comprise at least one duct or groove permitting the passage of oil therethrough and thus interconnecting the sections of the annular space.

The riser pipe 7 is eccentrically located with respect to the pivotal structure so that several riser pipes such as 7 may be positioned and regularly spaced about the axis of the pivoted structure. The distance of eccentricity is sufficiently small in each case to permit the lower section 13 to pass through an axial passage 25 in the universal joint 5.

A safety device for the lower section 13 consists of a rupturable duct 26 fixed to the lower section and connected to the hydraulic control circuit for the safety valves 8' of the collector pipe 8 by means of a duct 26' attached to the sections of the pipe 7. The safety valves are of the motorized type and close due to lack of pressure in the control circuit.

The duct 26' extending from the rupturable duct 26 passes through the connector 15 via the longitudinal bore in the body of said connector 15. The duct 26' passes through the seal 18 via a passage in the body of the upper section 17. The duct 26' is attached to the sections of the pipe 7 by means of easily removable hooks made of a flexible material in order to permit the installation and removal of the pipe 7.

On FIG. 1 the lower pipe section 13 is at one side of the center of the universal joint. This arrangement has been retained because it provides the best distribution of the bending forces along the lower section 13, thus contributing to the function of said lower section 13 which acts like a beam fixed at its two ends.

Figure 2:
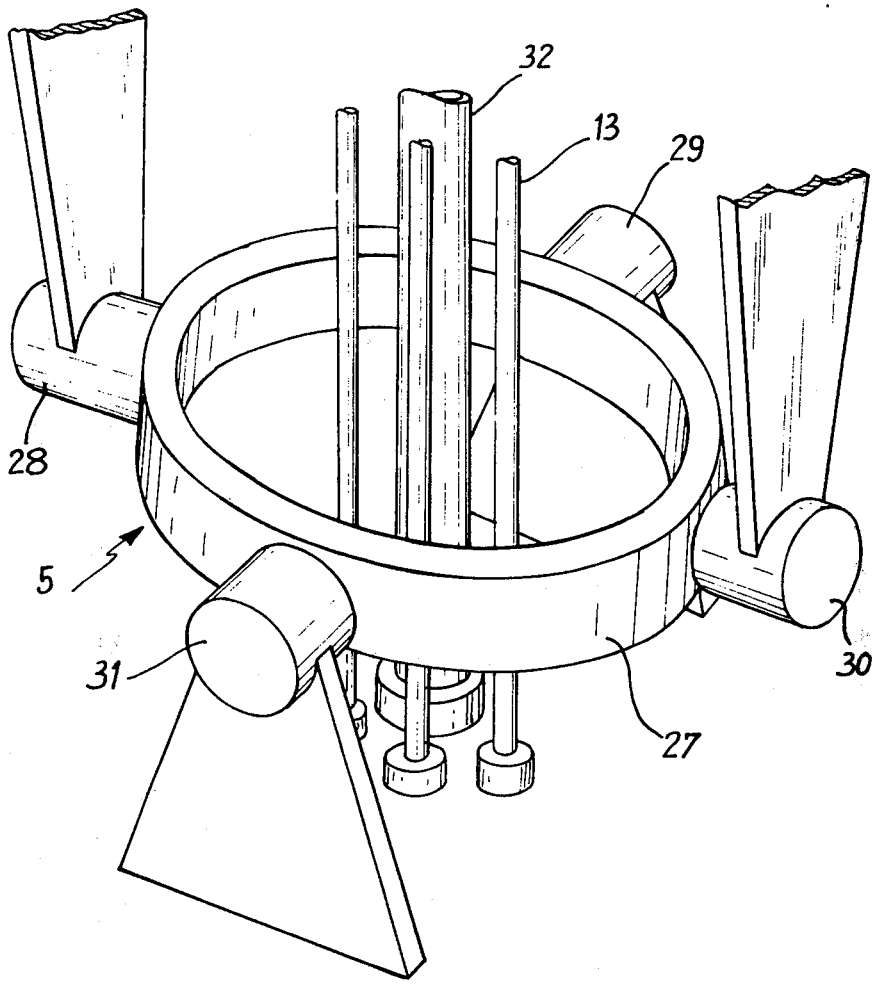
FIG. 2 shows the location of the pipes at the level of the universal joint connecting the pivotally mounted structure to its base.

FIG. 2 shows a universal joint 5, consisting in this case of a ring 27 carrying four pivot pins 28, 29, 30 and 31 extending radially in four directions at right angles to each other. Two opposed pins 28 and 30 have their bearings connected to the pivoted structure 1, the two other opposed pins 29 and 31 have their bearing connected to the base 4. The lower sections 13 of the riser pipes 7, which are regularly spaced about the axis of the ring, pass through the opening in that ring.

FIG. 1 shows, along the axis of the ring 27, a tube 32 made of an elastomeric material and connecting a tube 33 having a substantial diameter with respect to the diameter of the production pipe 7, to a base pipe 34. The tube 33 is centered in a guide shaft 33' fixed to the pivotal structure 1. The tube 32 is connected to the pipe 34 by a separable joint 14*a* which is preferably of the hydraulically actuated type. It is connected to the tube 33 by a connector consisting of a piston sliding in a cylindrical seat according to the general principal of the invention.

Such a tube 33 of substantial diameter may be used for the passage of gas from separators situated on the base and directed toward a torch located at some distance from the pivotal production structure or for the transfer of degassed oil to storage reservoirs, or for the transport of polyphase mixtures.

On the base pipe 34 is mounted a safety valve 8'*a* which is closed by a drop in the pressure in the hydraulic control circuit, which is in turn caused either by manual action or by the operation of a safety device, not shown.

Figure 3:
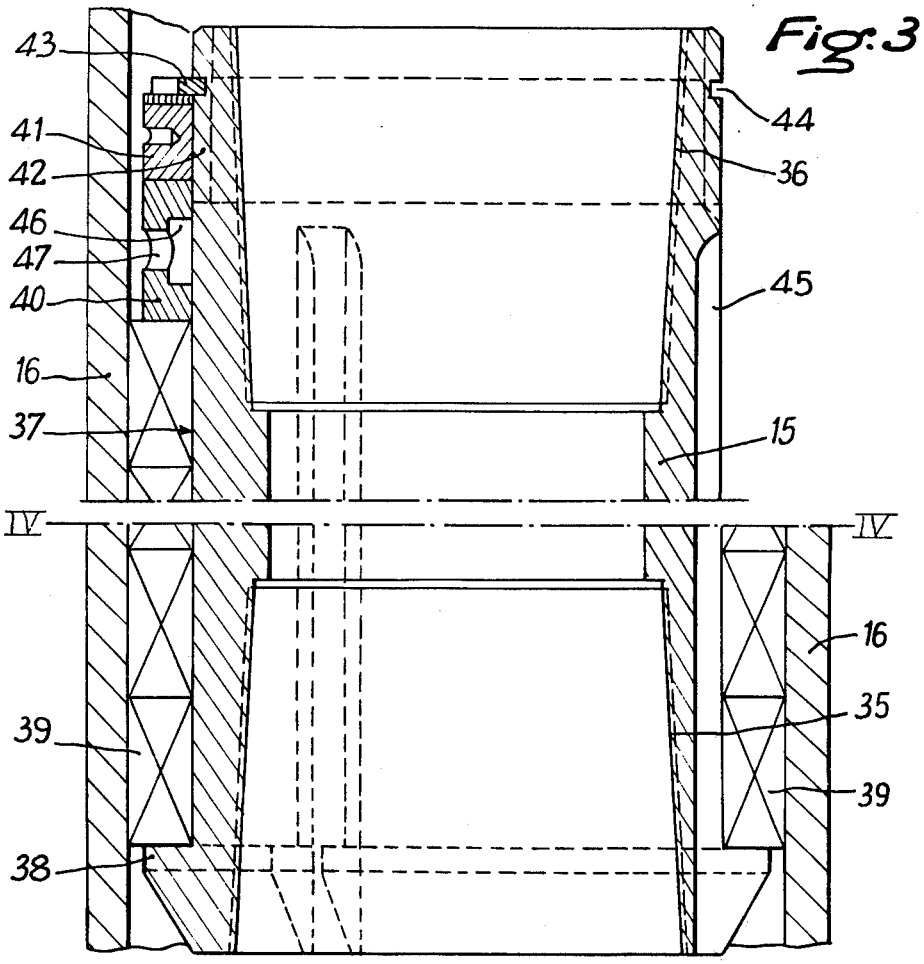
FIG. 3 is a sectional view taken through the connector which constitutes a piston sliding in the guide shaft.

FIG. 3 is a longitudinal sectional view taken through the connector 15. This connector 15 comprises at its lower end a female thread 35 for thelower pipe section 13 and at its upper end a female thread 36 for the next section of production pipe in the riser pipe 17.

The outer surface 37 of the connector is cylindrical in shape and limited at its lower end by an annular rib 38.

A plurality of teflon rings such as 39, which are substantially rectangular in section, is disposed on the cylinder 37 to a total height of the order of 30 centimeters. The rings 39 are slid onto the cylinder 37 from the to and abut against the annular rib 38. They are held in place by a ring 40 followed by a nut 41, screwed onto threads 42 formed on the upper part of connector 15, and locked at the top by a spring 43 consisting of a split retaining ring partially seated in an annular groove 44 in the external surface of the connector 15.

FIG. 3 shows three grooves 45 extending longitudinally of the outer surface of the connector 15 between the lower end of the connector 15 and the zone encircled by the ring 40. The ring 40 has on its internal surface an annular groove 46, said groove being in communication with the external surface of the ring through a plurality of bores 47. The annular spaces above and below the connector 15 are in communication with each other through the grooves 45 in the connector 15, 46 in the rings 40, and the bores 47. When the connector 15 moves with respect to the sleeve 16 and thus with respect to the guide shaft 11, oil is displaced through the groovesand bores thus avoiding the apparition of any excess pressure or partial vacuum in the annular space above the connector 15.

Figure 4:
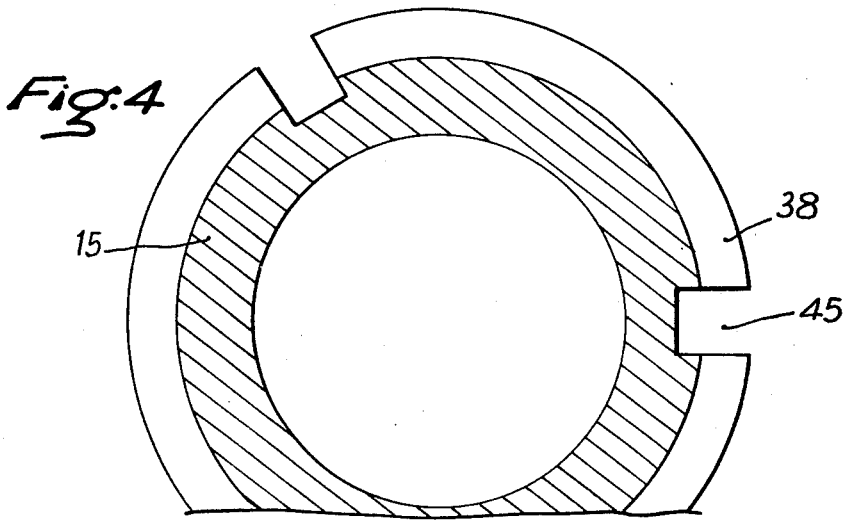
FIG. 4 is a right sectional view taken through the connector.

FIG. 4 is a right section taken through the connector 15 along the line IV—IV and shows the respective positions of the rib 38 and the groove 45 intersecting said rib 38.

Figure 5:
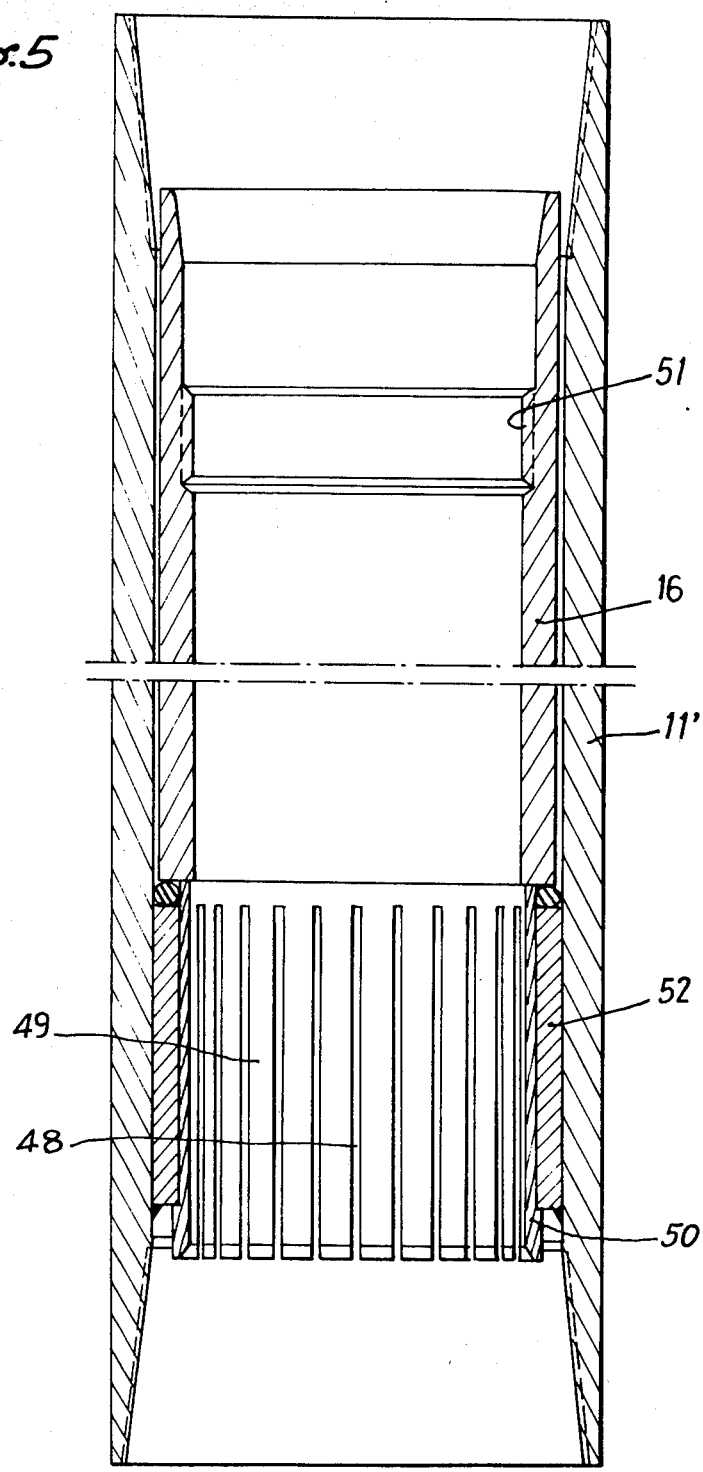
FIG. 5 is a sectional view taken through the sleeve in which the connector slides, which sleeve is anchored to its seat.

FIG. 5 shows the sleeve 16 in which the connector 15 slides, said sleeve 16 being anchored in the lowr member 11' of the guide shaft 11. The sleeve 16, the cylindrical inner surface of which is polished, comprises at its lower end an anchoring device represented on the figure, by way of example, by a collar 48, comprising a plurality of longitudinal elastic fingers 49 made of steel and carrying thickened parts 50 toward their ends. At its upper end the collar has an internal screw thread 51 for screwing in a fishing tool of a conventional type which is itself screwed to the end of a string of production pipes, not shown.

The lower member 11' of the guide shat 11 is located in an annular seat 52 fixed by welded seams at its lower end to the inner surface of the lower member 11'. When the sleeve is being mounted the longitudinal fingers 49 curve inwardly when they enter into contact with the seat. They straighten into locking position when the thickened parts 50 pass beneath the annular seat 52. The anchorage is thus completed.

The part of the thickened parts 50 contacting the seat is slightly inclined so that upward traction suffices to disconnect the sleeve when its return to the surface is required in order to carry out some necessary step, such as replacement.

The embodiment which has been described illustrates the invention in two ways. One is the case of a pipe composed of sections of production pipe which are eccentric with respect to the pivotally attached structure and a plurality of which may be installed. The other relates to a tube having larger dimensions than those generally selected for production pipes, which is especially adapted to occupy the axis of the pivoted structure, the lower member of which tube is preferably made of a reinforced elastomer.

The general principles of the invention may be applied to various different embodiments of these two concepts, depending on the type and characteristics of the pipe sections making up the pipe and by their eccentric positon.

The riser pipe according to the inventon and as it has been described by way of example offers the considerable advantage over known devices of referring the bending forces to a lower section production pipe along which these efforts are equally distributed since the lower section acts as a beam seated at its two ends.

The choice of the diameters of the different parts makes it possible to replace the pipe 7 and then the sleeve 16 inside the guide shaft 11, which makes it possible to easily change the lower section 13 and possibly the sleeve 16 and piston 15, all of which are members subject to wear.

The use of a frangible duct 26 fixed to the lower section 13 as a precaution against rupture makes it possible to provide instantaneous protection of the installation in the case of premature breakage of the lower member.

What is claimed is:

1. In apparatus for extracting petroleum from beneath a body of water, which apparatus comprises a base at the bottom of said body of water, a base pipe carried by said base, an elongated structure pivotally attached at its lower end to said base by means of a universal joint and projecting above the surface of said body of water, a hollow guide shaft fixed to said structure and extending downward from above said surface toward said base, a plug closing the top of said guide shaft, a pipe within said guide shaft made from a plurality of successive pipe sections, one of which is lowermost, and at least one elastic centering device which centers said pipe in said guide shaft and comprises means providing communication between the spaces between said pipe and shaft above and below said centering means, the improvement which comprises:

a remotely controlled releasable connector occupying a stationary position and comprising a first part fixed to said lowermost pipe section and a second part fixed to said base pipe, a slidable connector connecting said lowermost pipe section to the one above it, and a cylindrical sleeve in said guide shaft within which said slidable connector is slidable, said sleeve having an inner diameter slightly less than that of the remainder of said guide shaft, said slidable connector comprising means providing communication between the spaces below said pipe and guide shaft above and below said connector, and the part of said releasable connector fixed to the lowermost section of said pipe having an external diameter less than the internal diameter of said sleeve.

2. Apparatus as claimed in claim 1 in which said lowermost pipe section has polished inner and outer surfaces priovided with an anti-corrosion coating.

3. Apparatus as claimed in claim 1 in which the cylindrical sleeve has an outer diameter slightly less than the inner diameter of the guide shaft, said sleeve being attached to anchoring means fixed to the inside of the guide shaft near the lower end of the guide shaft.

4. Apparatus as claimed in claim 1 comprising a safety valve and in which the lowermost section of the pipe is provided with a safety device consisting of a frangible tube fixed to said lowermost section and connected to a hydraulic control circuit for said safety valve, which is of the motorized type adapted to close in the absence of pressure in the control circuit.

5. Apparatus as claimed in claim 1 in which the axis of the lowermost pipe section is in alignment with a point on said bottom to one side of the center of the universal joint.

6. Apparatus as claimed in claim 1 in which the annular plug in the top of the guide shaft is readily removable and, when removed, clears the entire section of the guide shaft.

7. Apparatus as claimed in claim 1 in which the guide shaft is surmounted by means for suspending the pipe at constant tension.

8. Apparatus as claimed in claim 1 in which said sections are sections of production pipe.

9. Apparatus as claimed in claim 1 in which the lowermost section is an elastomeric tube.

10. Apparatus as claimed in claim 1 in which the lowermost section is a reinforced elastomeric tube.

11. Apparatus as claimed in claim 1 in which the lowermost pipe section passes through an axial passage in the universal joint.

* * * * *